United States Patent [19]

Howard

[11] 4,188,656

[45] Feb. 12, 1980

[54] LIGHT FRAME ADAPTER

[76] Inventor: Norman W. Howard, 3803 Brooklyn Crescent NW., Calgary, Alberta, Canada, T2L 1G9

[21] Appl. No.: 952,156

[22] Filed: Oct. 17, 1978

[30] Foreign Application Priority Data

Jul. 17, 1978 [CA] Canada ..... 307538

[51] Int. Cl.[2] ..... F21S 3/06

[52] U.S. Cl. ..... 362/365; 362/396; 362/404

[58] Field of Search ..... 362/257, 364, 365, 396, 362/404

[56] References Cited

U.S. PATENT DOCUMENTS 3,294,967 12/1966 Pascucci ..... 362/404 X

*Primary Examiner*—Stephen J. Lechert, Jr.

*Attorney, Agent, or Firm*—Colton & Stone, Inc.

[57] ABSTRACT

An adapter for mounting in wallboard-type or other planar ceilings so as to permit the utilization of light fixtures which hitherto could only be used in inverted tee-bar types of suspended ceilings. The adapter includes a plurality of frame members, one for each edge of a ceiling opening, each frame member being configured to have a flange for abutting against the lower ceiling surface and a shoulder thereabove. Corner members for each corner of the adapter have a planar wall and a flange extending from the lower edge thereof. The corner members are transversely adjustable relative to the frame members. In use the ceiling panel is clamped between the flanges of the corner members and those of the frame members and the light fixture is positioned in the opening so that the peripheral lower edge of the fixture rests on the shoulders of the frame members.

14 Claims, 2 Drawing Figures

LIGHT FRAME ADAPTER

The present invention relates to ceiling light fixtures and more particularly to an adapter for mounting light fixtures in a ceiling.

BACKGROUND OF THE INVENTION

There are many types of light fixtures available to architects and engineers for utilization in new construction or renovation. In most instances the type of fixture used depends on the ceiling construction. When inverted tee-bar suspended ceilings are used the grid defined thereby is a standard size and a simple box-type fixture may be positioned in the ceiling so that its edges rest on the flanges of the grid defining the ceiling opening. When wall-board type ceilings are used, more expensive fixtures having exposed flanges and "swing-out" hangers (or other awkward mounting hardware) must be used. In the latter case the fixture has means for mounting the housing thereof to the ceiling and further means for permitting access to the interior for repair or replacement of the component parts.

In the suspended grid type of ceiling repair is effected by simply removing the entire fixture from the grid by bringing it down through the ceiling opening. The fixture is not permanently attached to the ceiling as in the latter case.

SUMMARY OF THE INVENTION

The present invention provides an adapter which permits the use of the simple light fixture described above in construction situations which would hitherto have required a more complex and expensive installation. In essence, the adapter of the present invention simulates an inverted tee-bar grid support which provides a peripheral shoulder on which the edges of the simple box-like fixture may rest. The adapter is especially effective with wallboard or gypsum board ceilings although it can be used with any type of ceiling in which an opening for the fixture may be provided. By using the adapter of the present invention more widespread use may be made of the simple fixture and it could become more universal, thereby simplifying the work of architects, engineers and contractors in the specification, design, acquisition and installation of lighting fixtures in new construction or renovation.

With the present invention an opening, usually rectangular, is provided in the ceiling. The adapter includes a plurality of frame members, one for each edge of the opening. In wallboard type ceilings each frame member would have a first wall portion, a flange extending outwardly from one longitudinal edge of the first wall portion, a shoulder extending outwardly from the other longitudinal edge of the first wall portion, and a second wall portion extending from the outer edge of the shoulder away from the flange. A plurality of corner members are provided, each having a generally planar wall and a flange extending from the lower edge thereof. A corner member is connected to a frame member adjacent each end thereof and is transversely adjustable relative thereto. The adjacent flanges of each corner member and frame member define a space therebetween for receiving a portion of the ceiling. Thus, the frame members are clamped to the ceiling peripherally of the opening therein and the light fixture may be positioned in the completed adapter so as to rest on the shoulder of the frame members.

In ceilings where ceiling panels or decorative trims are placed about the opening, it is possible to eliminate the flanges on each frame member so that each member includes only the first and second wall portions and the interconnecting shoulder. The weight of the fixture resting on the shoulders of the frame members would be borne by the flanges on the corner members as in the wallboard situation although the clamping action of that situation would be absent.

The components of the present invention are easily manufactured from sheet material or an extrudate and they may be easily assembled into the completed adapter. They may be provided in fixed lengths to accommodate fixtures of known dimensions, for example, 1'×4', 2'×2' and 2'×4' or they may be cut from longer lengths at the construction site. Above all, they permit the use of less expensive lay-in types of light fixtures to be utilized in situations which would otherwise call for more expensive, and more difficult to install, light fixtures.

DESCRIPTION OF THE PREFERRED EMBODIMENT

Figure 1:
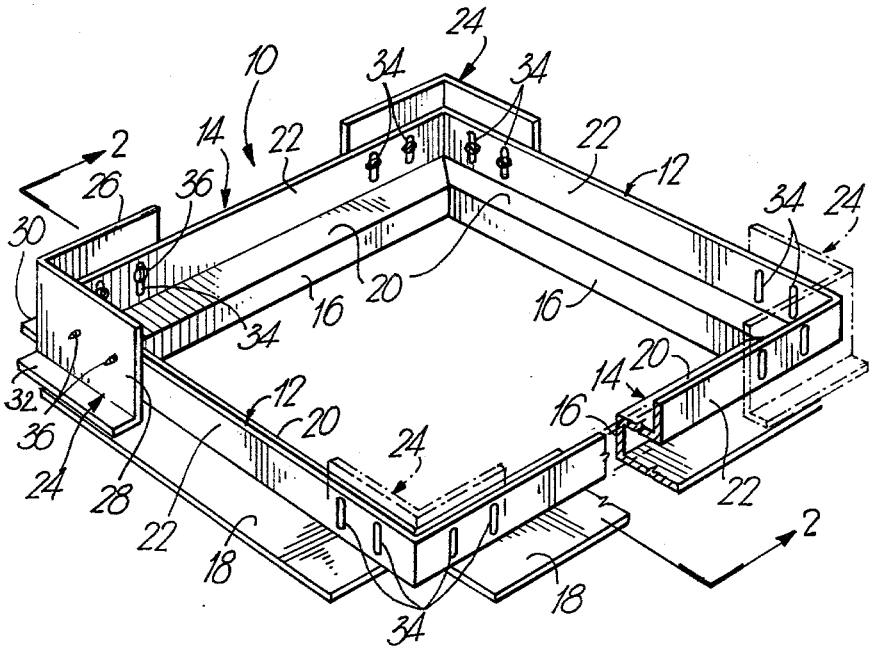
FIG. 1 shows a perspective view of the adapter of the present invention with certain portions omitted for clarity.
Figure 2:
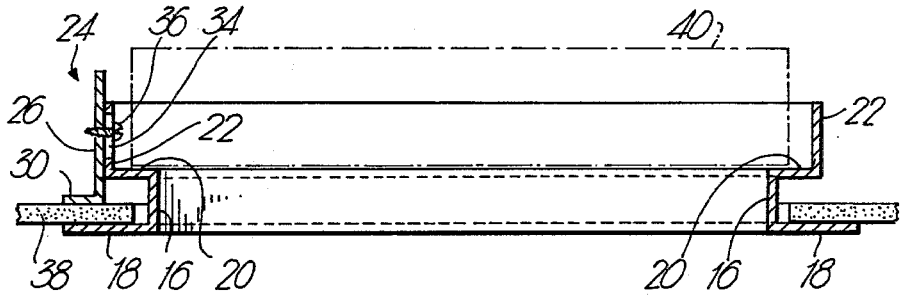
FIG. 2 shows the section on line 2—2 of FIG. 1 showing in addition a portion of a ceiling panel.

The adapter of the present invention is illustrated as item 10 in FIG. 1. It includes a plurality of frame members 12,14, the members being shown as assembled in the configuration of a rectangle with members 12 being opposite each other and members 14 being opposite each other. As is best seen in FIG. 2, each frame member has a first wall portion 16, a flange 18 extending outwardly from one longitudinal edge of wall portion 16, a shoulder 20 extending outwardly from the other longitudinal edge of the wall portion 16, and a second wall portion 22 extending from the shoulder 20 away from the flange 18. The manufacture of the frame members 12,14 is very simple and conventional. They may be roll formed or bent to shape on a brake. This would be appropriate if they are formed from sheet material such as aluminum or steel. They could also be extruded from aluminum or a plastics material. Furthermore, since each frame member is intended to fit along one appropriate edge of a ceiling opening it is contemplated that the correct length of frame member could be cut from a longer length of formed material at the construction site although it is more desirable to utilize completed members of the correct length.

As contemplated in FIG. 1, a corner member 24 is provided, there being one such member for each corner of the adapter. Only one member is shown in FIG. 1 for the sake of clarity. Each corner member 24 includes a pair of planar walls 26,28 joined together along one vertical edge thereof. A flange 30 extends outwardly from the lower edge of wall 26 while a similar flange 32 extends outwardly from the lower edge of wall 28.

FIG. 1 also shows means for connecting the corner members to the frame members for transverse (i.e. vertical) adjustment relative thereto. This means includes a pair of vertically oriented slots 34 adjacent each end of a frame member, each receiving a threaded fastener 36. In the preferred embodiment self-tapping sheet metal screws are used, each screw being received in an appropriate corresponding hole in the corner plate. It is understood that any other configuration permitting adjustment of the corner member transverse of the frame member could be utilized.

The use of the adapter is best shown in FIG. 2. As seen therein each frame member is connected to a respective corner member and is inserted into the opening in the ceiling so that the flange 18 abuts against the underside of a ceiling panel 38 defining the opening. The workman can then move the corner members downwardly until the flanges 30, 32 thereof abut the upper surface of the ceiling panel 38 and then tighten the screws 36 whereby the ceiling panel is clamped in the space defined between the flanges 18 and 30. This is repeated at each corner until all frame members 12,14 are rigidly held in place, there being one frame member for each edge of the opening. The light fixture, shown in chain-dotted lines as item 40, is manoeuvered into the opening defined by the frame members 12,14 and then is positioned so that its peripheral lower edge rests on the shoulders 20.

When the ceiling is formed of wallbroad the angle between flange 18 and wall portion is about 87° to provide in effect a corner bead to trowel to and hence the raw edge of flange 18 will be concealed by the joint filler.

The adapter of the present invention also lends itself to certain modifications, some of which are outlined hereinbelow.

It would be possible for example to eliminate the flange 18 if the ceiling were to be finished with tiles applied to the board 38 or if a decorative moulding were to be attached about the periphery of the ceiling opening. In this case the corner members 24 would be adjusted so that the lower longitudinal edge of the wall portions 16 extends to or just slightly beyond the lower surface of the board 38. Support for the adapter would primarily be provided by the flanges 30,32 abutting on the upper surface of the board 38.

Another modification of the basic invention would involve the use of separate corner members for each end of a frame member rather than a single unitary corner member such as 24 positioned at each corner. In essence there would be no join between the walls 26 and 28. While the resulting adapter would be slightly less rigid than if a unitary corner member were used, it should be remembered that a certain, and sufficient, degree of rigidity is achieved by the clamping action provided between the flanges 30,32 and the flanges 16.

While FIG. 2 shows flange 18 extending outwardly a greater distance than shoulder 20 and flange 30 essentially making up the distance between the edge of flange 18 and the shoulder 20, this configuration is not essential to operability.

Certain structural constraints may require shoulder 20 to be equal in width, if not wider than, flange 18. In fact, in one commercial embodiment flange 18 and shoulder 20 are each ½ inch wide, wall portion 16 is 1⅛ inches high, wall portion 22 is 1 inch high, corner walls 26,28 are 2 inches high and corner flange 32 is ⅜ inch wide.

It would even be possible, although not necessary, to utilize corner members wherein the flanges 30,32 extended inwardly, towards the frame member, rather than outwardly as shown in the drawings. With this configuration the ceiling panel would still be clamped between the flanges of the corner members and those of the frame members.

Thus, the present invention provides an adapter which can be easily manufactured and which can be easily assembled to the ceiling. The use of such an adapter permits the use of less expensive light fixtures, including those that otherwise would be only usable in tee-bar types of suspended ceilings. The use of the present adapter could also reduce the number of different light fixtures that must be specified in new construction or renovation since any one type of fixture may now be used in more situations than before. Finally by using the adapter of the present invention and appropriate drop-in fixtures, it is possible to readily remove the fixture to gain access to the ceiling cavity through the ceiling opening.

It is understood that modifications other than those enumerated above are possible without departing from the spirit of the invention. The scope of protection afforded the present invention is to be determined from the appended claims.

The embodiments of the invention in which an exclusive property or privilege is claimed are defined as follows:

1. An adapter for mounting a light fixture in a ceiling opening, comprising:

a plurality of frame members, one for each edge of said opening, each frame member having a first wall portion, a flange extending outwardly from one longitudinal edge of said first wall portion, a shoulder extending outwardly from the other longitudinal edge of said first wall portion and adapted to support a light fixture, and a second wall portion extending from the outer edge of said shoulder away from said flange;

a plurality of corner members, each having a generally planar wall and a flange extending from a lower edge thereof; and means connecting a corner member to a frame member adjacent each end thereof for transverse adjustment relative thereto, the adjacent flanges of each corner member and frame member defining a space therebetween for receiving a portion of said ceiling and clampingly engaging said portion.

2. The adapter of claim 1 wherein the flange and first wall portion of each frame member form an angle of about 87° and the first and second wall portions of each frame member are generally perpendicular to said shoulder.

3. The adapter of claim 2 wherein the flange of each frame member extends outwardly from the first wall portion a distance greater than that of the shoulder, and said flange on said corner member extends outwardly thereof.

4. The adapter of claim 3 wherein said distance is generally equal to the distance the flange on each corner member extends outwardly from the wall thereof.

5. The adapter of claim 2 wherein the shoulder of each frame member extends outwardly a distance at least equal to the outward extension of said flange, and said flange on said corner member extends outwardly thereof.

6. The adapter of claim 2 wherein the shoulder of each frame member extends outwardly a distance at least equal to the outward extension of said flange and said flange on said corner member extends inwardly thereof.

7. The adapter of claim 1 wherein a pair of said corner members are joined together along adjacent vertical edges of the walls thereof to form a single, unitary corner member, there being one such unitary member for each corner of said adapter.

8. The adapter of claim 1 wherein said means includes a pair of parallel vertical slots in said second wall portion and threaded means extending through said slots to the wall of the associated corner member.

9. An adapter for mounting a light fixture in a ceiling opening, comprising:

a plurality of frame members, one for each edge of said opening, each frame member having a first wall portion, a flange extending outwardly from one longitudinal edge of said first wall portion, a shoulder extending outwardly from the other longitudinal edge of said first wall portion and adapted to support a light fixture, and a second wall portion extending upwardly from the outer edge of said shoulder parallel to said first wall portion;

a plurality of corner members, each having a pair of walls and a flange extending outwardly from a lower edge of each wall; and means connecting each corner member to an associated pair of frame members for vertical adjustment relative thereto, the adjacent flanges of said corner member and frame members defining a space therebetween for receiving a portion of said ceiling and clampingly engaging said portion.

10. The adapter of claim 9 wherein the shoulder of each frame member is generally perpendicular to the first and second wall portions thereof.

11. The adapter of claim 10 wherein the flange of each frame member extends outwardly from the first wall portion a distance greater than that of the shoulder.

12. The adapter of claim 11 wherein said distance is generally equal to the distance the flange on each corner member extends outwardly from the wall thereof.

13. The adapter of claim 9 wherein said means includes a pair of parallel vertical slots in said second wall portion and threaded means extending through said slots to the wall of the associated corner member.

14. An adapter for mounting a light fixture in a ceiling opening, comprising:

a plurality of frame members, one for each edge of said opening, each frame member having a first wall portion, a shoulder extending outwardly from one longitudinal edge thereof and adapted to support a light fixture, and a second wall portion extending from the outer edge of said shoulder away from said first wall portion;

a plurality of corner members each having a generally planar wall and a flange extending from the lower edge thereof; and means connecting a corner member to a frame member adjacent each end thereof for transverse movement relative thereto, the flange on each corner member being adapted to abut against an upper surface of said ceiling peripherally around said ceiling opening.

* * * * *